US006024804A

United States Patent [19]

Ferra et al.

[11] Patent Number: 6,024,804

[45] Date of Patent: Feb. 15, 2000

[54] METHOD OF PREPARING HIGH NODULE MALLEABLE IRON AND ITS NAMED PRODUCT

[75] Inventors: Charles Robert Ferra, North Canton; Mark D. Koepsel, Canton, both of Ohio

[73] Assignee: Ohio Cast Products, Inc., Canton, Ohio

[21] Appl. No.: 08/850,329

[22] Filed: May 2, 1997

[51] Int. Cl.[7] ..... C22C 37/10; C21D 5/06

[52] U.S. Cl. ..... 148/32; 148/545; 148/617; 148/618

[58] Field of Search ..... 148/321, 545, 148/617, 618; 420/9

[56] References Cited

U.S. PATENT DOCUMENTS

| | | | |
|---|---|---|---|
| 2,345,055 | 7/1944 | Powers | 148/21.55 |
| 3,511,721 | 5/1970 | Light | 148/138 |
| 3,661,566 | 5/1972 | Percheron et al. | 75/130 R |
| 3,975,191 | 8/1976 | Rote | 75/130 R |
| 4,084,962 | 4/1978 | Robinson | 75/130 A |
| 4,099,994 | 7/1978 | Ikawa et al. | 148/35 |
| 4,222,793 | 9/1980 | Grindahl | 148/2 |
| 4,363,661 | 12/1982 | Kovacs | 75/130 R |
| 4,435,226 | 3/1984 | Neuhauser et al. | 148/3 |
| 4,475,956 | 10/1984 | Kovacs et al. | 148/3 |
| 4,579,164 | 4/1986 | Hartley et al. | 164/55.1 |
| 4,874,576 | 10/1989 | Reifferscheid | 420/22 |
| 4,889,687 | 12/1989 | Ishihara et al. | 420/13 |
| 4,889,688 | 12/1989 | Suenaga et al. | 420/22 |
| 5,041,173 | 8/1991 | Shikata et al. | 148/321 |
| 5,043,028 | 8/1991 | Kovacs et al. | 148/321 |
| 5,139,579 | 8/1992 | Kovacs et al. | 148/545 |
| 5,370,752 | 12/1994 | Saki | 148/331 |

FOREIGN PATENT DOCUMENTS

| | | |
|---|---|---|
| 3407010 | 10/1986 | Germany . |
| 94104846 | 12/1994 | Japan . |

OTHER PUBLICATIONS

A.A. Hussein et al., "First Stage Graphitization of Subcritically Treated White Cast Iron" Physical Metallurgy of Cast Iron, Proceedings of the Third International Symposium, 1984, pp. 315–324 (abstract only).

ASM International, *Metals Handbook*, "Malleable Iron" tenth ed., vol. 1, pp 71–84, 1990.

Dr. Askeland et al., "Secondary Graphite Formation in Tempered Nodular Cast Iron Weldments" *Welding Journal* vol. 58, No. 11, Nov. 1979, pp. 337, 1979.

International Search Report in International Application No. PCT/US 99/09446, Jul. 22, 1999.

*Primary Examiner*—Deborah Yee

*Attorney, Agent, or Firm*—Thompson Hine & Flory LLP

[57] ABSTRACT

The invention is a malleable iron comprising about 250 to 400 nodules of graphite per square millimeter as observed in a photomicrograph at 100×, and a Brinell hardness of about 195 to 550 BHN. Preferably, the malleable iron further comprises sulfur and manganese wherein the manganese is present in an excess amount of at least 2 times the amount of sulfur plus 0.15% and is formed by two separate quenching steps. The invention further comprises a method of preparing a malleable iron having a high nodule count comprising the steps of prenucleating a malleable iron casting at a temperature of about 600 to 900° F. for about 3 to 6 hours; austenitizing the prenucleated casting at about 1680 to 1740° F. for about 3 to 9 hours to form graphite nodules such that the malleable iron has about 250 to 400 nodules per $mm^2$; and quenching the casting to form pearlite and a malleable iron made by this process.

12 Claims, 1 Drawing Sheet

METHOD OF PREPARING HIGH NODULE MALLEABLE IRON AND ITS NAMED PRODUCT

BACKGROUND OF THE INVENTION

The present invention relates to a malleable iron having high hardness and good lubricity and wear resistance, and more particularly, this invention relates to a malleable iron having at least 250 graphite nodules per square millimeter and a method of making such a metal.

There are three types of cast irons: malleable, ductile and gray iron. Of these, malleable and ductile irons can be plastically deformed. These irons can be differentiated by their microstructures. Gray iron has most of its carbon in the form of flakes which resemble the shape of potato chips. Malleable iron has most of its carbon in the form of irregularly shaped graphite nodules also known as "temper carbon" which resemble the shape of popped popcorn. Ductile iron, which can also be referred to as "nodular" or "spheroidal" iron, contains carbon in the form of small round graphite spherulites.

The carbon in malleable iron is predominantly in the form of graphite. Typically, malleable iron contains about 50 to 100 graphite nodules per $mm^2$.

Malleable iron is first cast as a white iron and then annealed at temperatures that result in the decomposition of cementite (iron carbide, $Fe_3C$) and convert the iron matrix into ferrite, pearlite, or combinations thereof. Ferrite is practically pure iron. Pearlite is a eutectoid structure comprised of alternative layers of ferrite and cementite. The chemical composition of malleable iron is generally 2.0 to 2.9% carbon, 0.9 to 1.9% silicon, 0.2 to 1.0% manganese, 0.02 to 0.2% sulfur, and 0.02 to 0.2% phosphorus. Unless otherwise noted, all percentages herein are by weight. Small amounts of chromium, boron, copper, nickel and molybdenum may also be present.

The iron for most present-day malleable iron is melted in coreless induction furnaces. The melting can be accomplished by batch cold melting or by duplexing. Molds are produced in green sand, silicate $CO_2$ bonded sand or resin-bonded sand (shell molds). Then the melted iron is poured into the molds. Molten iron produced under properly controlled melting conditions solidifies with all carbon in the combined form, producing white iron for ferritic or pearlitic malleable iron. After the casting solidifies and cools, the metal is in a white iron state and any gates, sprues and feeders are removed from the castings. The castings are then heat treated. It is known to add agents such as magnesium, cerium, boron, aluminum and titanium to the molten metal to enhance the nodular forming properties.

The initial annealing converts the carbon that exists in combined form massive carbides ($Fe_3C$) or microconstituents in pearlite into temper carbon. Conventionally, the first state anneal is approximately 9–15 hours and up to 5 days at about 900 to 970° C. (1650 to 1780° F.). However, irons with lower silicon contents may require as much as 20 hours for completion of first-stage annealing. The initial anneal is followed by additional heat treatments that produce the desired matrix microstructures in the iron.

Conventionally, such a method produces a nodule count of about 50 to 100 discrete graphite particles per square millimeter as measured in a photomicrograph magnified at 100× (hereinafter all references to nodules/$mm^2$ are assumed to be measurement in a photomicrograph at 100×). The particle distribution is random, with short distances between the graphite particles. Temper carbon is formed predominantly at the interface between primary carbide and saturated austentite at the first stage annealing temperature, with growth around the nuclei taking place by a reaction involving diffusion and carbide decomposition.

Conventional malleable iron has fewer nodules (50 to 100 nodules/$mm^2$). Parts made from these irons do not exhibit sufficient lubricity for many applications requiring high wear. The diameter of the graphite nodules is large and abrasion tends to lift the nodules up causing them to pop out and form craters. This causes the machine parts to seize up and the parts fail. Thus, there is a need for a malleable iron which has an increased number of graphite nodules and a method of making such a metal.

SUMMARY

In accordance with the present invention, a malleable iron is provided having about 250 to 400 nodules of graphite per square millimeter (as determined by examination of a 100× photomicrograph), and a Brinell hardness of about 195 to 550 BHN. The Brinell hardness test is the standard of measuring the hardness of metal. The smooth surface of the metal is dented by a 10 mm steel ball under force. The standard load and time is 3000 kilograms for 30 seconds for steel and other hard metals. The diameter of the resulting dent is measured and the hardness determined from a chart or formula. Preferably, the malleable iron further comprises sulfur and manganese wherein the manganese is present in an amount which significantly exceeds two times the amount of sulfur (expressed as weight percent) plus 0.15%.

The invention further comprises a method of preparing a malleable iron having a high nodule count comprising the steps of prenucleating a casting of an iron capable of forming a malleable iron by heating at a temperature of about 600 to 900° F. for about 3 to 6 hours; austenitizing the prenucleated casting at about 1680 to 1740° F. for about 4 to 9 hours to malleablilize the casting and form graphite nodules; and quenching the casting to form pearlite, such that the malleable iron has about 250 to 400 nodules per $mm^2$. In a preferred embodiment, the method further comprises the steps of melting an iron containing carbon, silicon, manganese and sulfur, and pouring the melt into a mold to form a casting, prior to the step of prenucleation. The quench is preferably performed using forced air and is carried out so as to reduce the temperature of the casting to about 700 to 1000° F. The method further may comprise the step of heating at a temperature capable of stabilizing the casting and performing a second quench to form tempered martensite, wherein said second quench is conducted in oil.

In a further embodiment, the invention is a malleable iron made by the above-referenced process.

DETAILED DESCRIPTION OF THE INVENTION

Figure 1:
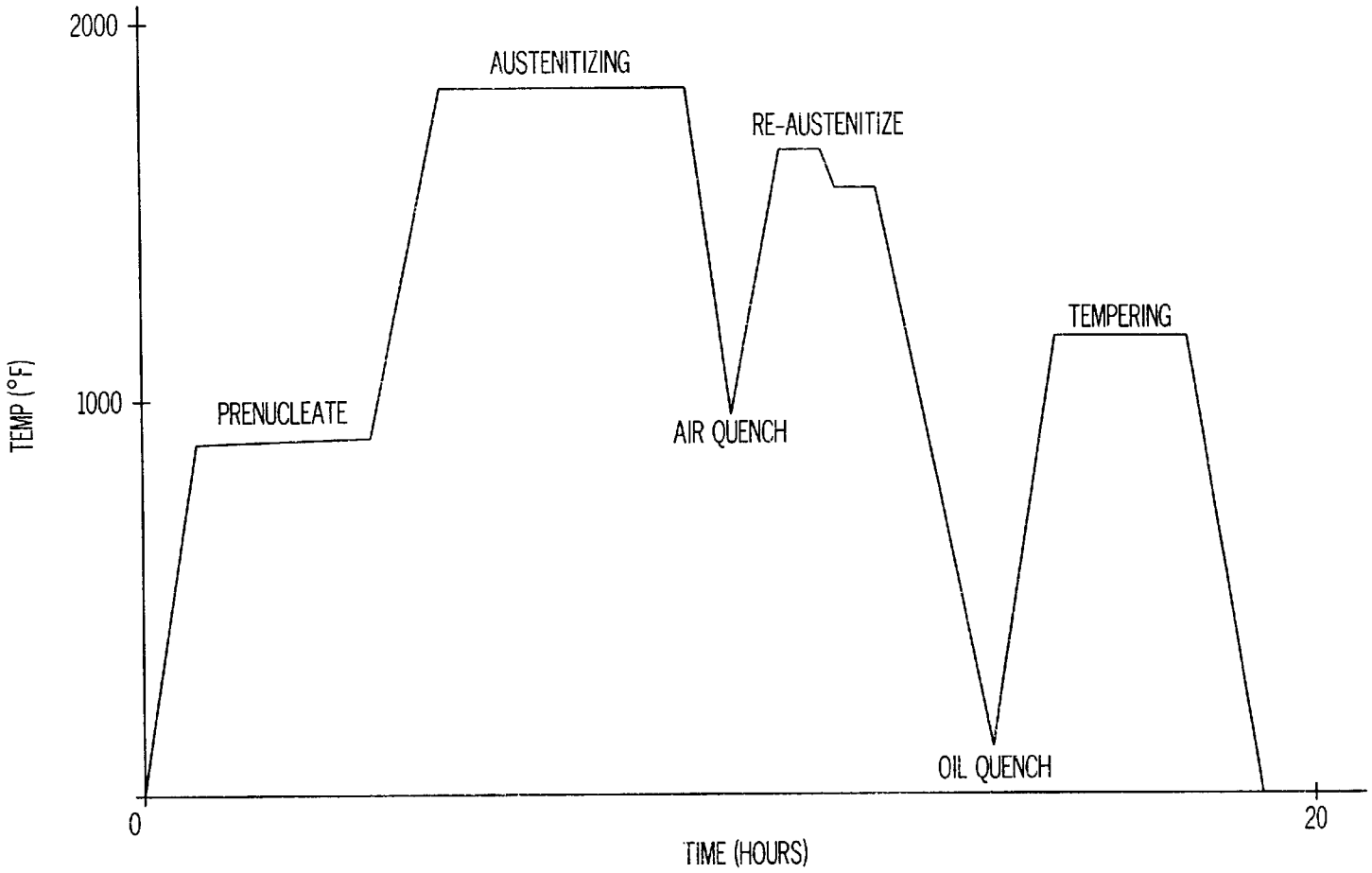
FIG. 1 is a typical heat treatment used to from the malleable iron of the present invention.

In accordance with the present invention, a malleable iron is provided which has a higher nodule content than that of conventional malleable irons. The malleable iron of the present invention is produced from a white cast iron and is heat treated to form a martinsitic matrix having a nodule count which equals that of some ductile irons. This results in a material with a high hardness, high lubricity and high temperature and wear resistance. This can be used for bearings, journals for air conditioning parts, or other applications which require high lubricity, high hardness and high temperature resistance. The malleable iron of the present invention has a nodule count of about 250 to 400 nodules/$mm^2$ and a hardness of about 195 to 550 BHN.

The method of making the malleable iron of the present invention is basically as follows. In a melt furnace, metal is liquified. The molten metal is poured into a sand mold having an impression of the casting, and cooled to about room temperature. The casting is separated from the mold and desprued. In accordance with the present invention, the casting is prenucleated in a heat treat furnace before heating to the austenitizing temperature. The casting is then air quenched.

The steel starting material which is placed in the melting furnace is preferably 60/40 steel (60% returns, sprue, castings, etc.; 40% steel). In addition, to the steel, other additives are added to the molten metal. These additives include carbon, manganese, silicon, and sulfur, and may additionally include one or more of phosphorus, chromium or bismuth. Typical additions are about 2.2 to 2.8% carbon, about 1.35 to 2.0% silicon, and about 0.30 to 0.85% manganese. Preferably, the additives are present in the following amounts: about 2.40 to 2.60% carbon, about 1.35 to 1.55% silicon, about 0.45 to 0.65% manganese, about 0.02 to 0.05% sulfur.

The amount of manganese should be such that there is a significant excess balance of manganese with respect to the sulfur in the melt. In conventional malleable iron, manganese is present in an amount of two times the percentage of the sulfur plus 0.15%. The iron used in the present invention should contain in excess of that amount of manganese. Preferably, the excess or free manganese should be present in an amount about at least 0.30% free manganese. Typical amounts of sulfur are about 0.02 to 0.05% and up to about 0.45 to 0.65% total manganese can be used for harder malleable iron. This gives a ratio of approximately 14 to 1 which is 325% in excess of industry standard ratios of 3 or 4 to 1.

A typical heat treatment that can be used to form the malleable iron of this invention is diagramed in FIG. 1.

The casting is prenucleated at about 600 to 900° F. for about 3 to 6 hours. This prenucleation step is designed to increase the nucleation sites for the graphite nodules thus leading to a greater number of nodules in the final product. The increase is due to the creation of vast areas of austenite/carbide interfaces. These interfaces act as favorable nucleation sites for graphite as well as providing shorter diffusion paths for carbon. In turn, the prenucleation decreases the size of the nodules. The prenucleation step is generally not effective if it is only carried out for about 1 to 2 hours. However, if the prenucleation step is substantially longer than about 6 hours, the carbon shape may start to deteriorate and become flaky.

After the prenucleation step, the casting is heated to about 1680 to 1740° F. and the casting is austenitized for about 3 to 9 hours. Temperatures in excess of this range are not recommended because they can lead to warped castings or scale. This treatment breaks down the primary carbides ($Fe_3C$). Austenitizing forces the carbon out of solution and into the graphite nodules at the nucleation sites formed during the prenucleation. After austenitizing for at least 3 hours, the iron is essentially free of carbide and contains about 250 to 400 nodules/$mm^2$. If the iron is austenitized too long surface decarbonization can result as ambient oxygen depletes the casting of carbon.

After austenitizing the casting is preferably air quenched to form pearlite. The forced-air quench is carried out to cool the metal to about 700 to 1000° F. This typically takes about 10 minutes. An air quenched structure prior to a subsequent oil quench provides a dispersion of graphite nodules in a matrix of iron carbide lamellae (pearlite).

After air quenching, the casting is heated and reaustenitized at about 1650° F. for 30 minutes and then cooled slightly to about 1575° F. and held for another 30 minutes to stabilize the microstructure. Upon heating during reaustenitizing, the carbon goes into solution faster from the air quenched structure since it has less diffusion distance to travel due to the iron carbide lamellae. Carbon diffusion is further enhanced by the small but highly dispersed high count graphite nodules.

The casting is then quenched in oil held at 125° F. for about 15 to 20 minutes. This results in a structure of quenched martensite. Martensite is a very hard needle like structure with a hardness approaching 600 BHN. The higher carbon content austenite is transformed to a higher carbon content martensite during the quench. The higher carbon content matrix with more carbide will result in increased wear resistance due to a higher micro-hardness. In place of an oil quench, a molten salt quench may be used such as potassium nitrate/sodium nitrite The iron is then tempered or drawn by reheating to a temperature below the critical range to secure final properties; typical temperatures are about 1100 to 1300° F. This tempering step relieves internal stresses, and depending on tempering temperature, spheroidizes the martensite needles. The resultant product is tempered martensite with typical BHN hardness of about 187 to 355. This hardness is advantageous for articles which must be machined since machinability is maximized in the 187 to 285 BHN range. Lower tempering temperatures reduces spheriodization of the martensite and can result in an extremely hard iron of 550 BHN. This is advantageous for high strength severe wear applications.

EXAMPLE

A charge of 60% returns, 40% iron is liquified in a melting furnace at 2700° F. The steel contains:

- 2.40 to 2.60% carbon
- 1.35 to 1.55% silicon
- 0.025–0.05% sulfur
- 0.45 to 0.65% manganese (>0.3 excess or free manganese)
- 0.0015 boron
- 0.015 titanium
- 0.015 aluminum The metal is poured into a sand mold having the impression of a casting and cooled to room temperature. The mold goes through a shake out process that separates the sand from the metal and removes the casting from the mold and sprues. The casting has a length of about 3 inches and a thickness of about ¾ inches. After it has been separated, the casting is prenucleated in a heat treat furnace at about 800° F. for about 4 hours, then heated to about 1720° F. for about 5 hours. Next the casting is quickly air quenched with forced air for about 10 minutes until it reaches about 700 to 1000° F. Following the first quench, the casting is reheated at about 1650° F. and cooled slightly to about 1575° and held at that temperature. The casting is cooled by an oil quench having a temperature of about 125° F. oil for about 15 to 20 minutes and tempered at 1200° F. for 1½ h and cooled to room temperature. The resulting malleable iron has a microstructure of tempered martinsitie having about 300 nodules/$mm^2$ and a Brinell hardness of about 300 BHN.

Having described the invention in detail and by reference to preferred embodiments thereof, it will be apparent that modifications and variations are possible without departing from the scope of the invention defined in the appended claims.

What is claimed is:

1. The method of preparing a malleable iron having a high nodule count comprising the steps of:

prenucleating a malleable iron casting at a temperature of about 600 to 900° F. for about 3 to 6 hours;

austenitizing said prenucleated casting at about 1680 to 1740° F. for about 3 to 9 hours to form graphite nodules such that said malleable iron has about 250 to 400 nodules/$mm^2$; and quenching said casting to form pearlite.

2. The method of claim 1 further comprising the step of, melting an iron mixture comprising carbon, silicon, manganese and sulfur, and pouring the melt into a mold to form a casting before said prenucleation step.

3. The method of claim 1 wherein the step of quenching is preformed using a forced air and transforms said iron into pearlite.

4. The method of claim 3 wherein the forced air quench reduces the temperature of said casting to about 700 to 1000° F.

5. The method of claim 4 further comprising the step of reheating said air quenched casting at a temperature capable of reaustenitizing said casting.

6. The method of claim 5 further comprising the step of quenching said casting a second time to form martensite.

7. The method of claim 6 wherein said second quench is carried out in oil and said step of quenching forms martinsitic needles in said casting.

8. The method of claim 6 further comprising the step of reheating to critical temperature to temper said casting.

9. The method of claim 8 wherein said tempering causes spheriodization of said martensite and reduces the hardness to about 185 to 355 BHN.

10. The method of claim 8 wherein said tempering causes a hard iron having a hardness of about 550 BHN.

11. A malleable iron made by the process of claim 1, said malleable iron consisting of about 2.20 to 2.80 weight percent carbon, about 1.35 to 2.0 weight percent silicon, and about 0.30 to 0.85 weight percent manganese about 0.02 to 0.05 weight percent sulfur, about 0.0015 weight percent boron, about 0.015 weight percent titanium, about 0.015 weight percent aluminum, and the balance iron.

12. A method of preparing a malleable iron comprising the steps of:

melting an iron mixture into a melt;

pouring said melt into a mold to form a casting;

prenucleating said casting at a temperature of about 600 to 900° F.;

austenitizing said prenucleated casting at a temperature of about 1680 to 1740° F. for about 3 to 9 hours;

air quenching said casting to form pearlite;

reaustentizing said air quenched casting;

quenching said casting a second time to form martinsite; and tempering said casting.

* * * * *